US012089721B2

(12) United States Patent
McGrath et al.

(10) Patent No.: US 12,089,721 B2
(45) Date of Patent: Sep. 17, 2024

(54) WATER RESISTANT HAIR POUCH

(71) Applicants: Gina Nicole McGrath, Laguna Hills, CA (US); Jaime Patrick McGrath, Laguna Hills, CA (US)

(72) Inventors: Gina Nicole McGrath, Laguna Hills, CA (US); Jaime Patrick McGrath, Laguna Hills, CA (US)

( * ) Notice: Subject to any disclaimer, the term of this patent is extended or adjusted under 35 U.S.C. 154(b) by 833 days.

(21) Appl. No.: 16/200,385

(22) Filed: Nov. 26, 2018

(65) Prior Publication Data

US 2020/0163431 A1 May 28, 2020

(51) Int. Cl.

| | |
|---|---|
| ***A42B 1/12*** | (2006.01) |
| ***A45D 8/40*** | (2006.01) |
| ***A63B 33/00*** | (2006.01) |
| *A42B 1/004* | (2021.01) |
| *A42B 1/008* | (2021.01) |

(52) U.S. Cl.

CPC ..... *A45D 8/40* (2013.01); *A63B 33/00* (2013.01); *A42B 1/004* (2013.01); *A42B 1/008* (2013.01); *A42B 1/12* (2013.01)

(58) Field of Classification Search

CPC .. A42B 1/004; A42B 1/12; A45D 8/34; A45D 8/40

See application file for complete search history.

(56) References Cited

U.S. PATENT DOCUMENTS

| | | | | | |
|---|---|---|---|---|---|
| 1,172,927 | A * | 2/1916 | Bloch | A42B 1/12 | 2/68 |
| D277,139 | S * | 1/1985 | DeFalco | D2/880 | |
| 5,465,741 | A * | 11/1995 | Dvorak | A45D 8/34 | 132/273 |
| 5,472,003 | A * | 12/1995 | Frame | A45D 8/34 | 132/273 |
| 5,595,199 | A * | 1/1997 | Solomon | A45D 8/00 | 132/273 |
| 5,727,575 | A * | 3/1998 | Rontal | A45D 8/34 | 132/200 |
| 5,878,756 | A * | 3/1999 | Bilodeau | A45D 8/40 | 132/274 |
| 7,293,566 | B2 * | 11/2007 | Thall | A45D 8/40 | 132/274 |
| D624,284 | S * | 9/2010 | Creel | D2/867 | |

(Continued)

*Primary Examiner* — Katherine M Moran
(74) *Attorney, Agent, or Firm* — Rutan & Tucker LLP; Hani Z. Sayed

(57) ABSTRACT

An apparatus and methods are provided for a water-resistant hair pouch that is secure, lightweight, easy to use, and capable of preventing tangles and water damage often encountered due to recreational swimming in pools, water parks, lakes, oceans, and the like. The water-resistant hair pouch comprises a pouch that tapers from an opening to an apex. The opening provides access to a water-resistant cavity inside the pouch. An elastic loop coupled with the pouch, adjacent to the opening, is configured to be wrapped around a ponytail that is inserted through the opening into the water-resistant cavity. A drawstring facilitates cinching the opening around the base of the ponytail to minimize water exposure to the hair, or maintain a dry state of the hair, during immersion in water. Straps are attached to opposite sides of the pouch to enable a practitioner to secure the ponytail within a folded configuration of the pouch.

20 Claims, 6 Drawing Sheets

(56) References Cited

U.S. PATENT DOCUMENTS

| | | | | |
|---|---|---|---|---|
| 8,061,366 | B2 * | 11/2011 | Britton | A45D 8/36 132/200 |
| 10,099,088 | B2 * | 10/2018 | Cason | A42B 1/24 |
| 2002/0056467 | A1 * | 5/2002 | Srivastava | A45D 8/34 132/273 |
| 2003/0029470 | A1 * | 2/2003 | Srivastava | A45D 8/40 132/274 |
| 2003/0200594 | A1 * | 10/2003 | McGreggor | A42B 1/049 2/202 |
| 2003/0221243 | A1 * | 12/2003 | Phillips | A42B 1/049 2/202 |
| 2012/0079643 | A1 * | 4/2012 | Clarke | A42B 1/041 2/171 |
| 2015/0359284 | A1 * | 12/2015 | Watson | A42B 1/12 2/174 |
| 2016/0198830 | A1 * | 7/2016 | Tussey | A42B 1/049 2/183 |
| 2017/0027262 | A1 * | 2/2017 | Palmer | A42B 1/12 |
| 2017/0042268 | A1 * | 2/2017 | Lessard | A42B 1/041 |
| 2017/0318885 | A1 * | 11/2017 | Smith | A42B 1/041 |
| 2017/0360138 | A1 * | 12/2017 | Guice | A42B 1/225 |
| 2018/0249804 | A1 * | 9/2018 | Walker | A45D 20/18 |

* cited by examiner

WATER RESISTANT HAIR POUCH

FIELD

Embodiments of the present disclosure generally relate to the field of hair covers. More specifically, embodiments of the disclosure relate to an apparatus and methods for a water-resistant hair pouch that is secure, lightweight, easy to use, and capable of preventing tangles and damage to hair often encountered due to recreational swimming in swimming pools, water parks, lakes, oceans, and the like.

BACKGROUND

Inconveniences due to water exposure typically include having to painfully comb through tangled, snarled hair as well as attempting to repair the effects of chlorine-damaged hair. Often times, damage due to chlorine in swimming pools necessitates cutting off damaged portions of hair, such as split ends and discolored hair, while leaving the hair dry, brittle, and unhealthy.

A possible option to preventing water damage to hair, caused by both chemical (chlorine) and natural (salt water) elements, is to wear a conventional swimming cap. Unfortunately, conventional swimming caps tend to be heavy, uncomfortable, and aesthetically lacking for recreational water activities other than competitive swim meets. As such, conventional swimming caps typically are not water resistant and not designed or intended to keep hair dry and prevent tangles, but rather swimming caps are configured primarily to keep the hair out of the face and reduce drag to assist with faster swimming during competition. Drawbacks to conventional swimming caps include pronounced heating of the head, as well as painfully constricting the head and forehead area. Removal of swimming caps typically causes undesirable pulling of the scalp, often leading to painfully tearing loose portions of the hair. Further, conventional swimming caps typically are silicone-based or include latex, which are known to cause potential allergic reactions in many swimmers.

Attempting to avoid the use of conventional swimming caps, many swimmers manipulate or treat their hair prior to entering the water. For example, long hair is often braided before swimming in an attempt to keep longer strands in place and reduce the likelihood of tangling. Unfortunately, braiding hair is a time-consuming process and poses a relatively high degree of difficulty when braiding one's own hair. In addition to a general lack of knowledge on various braiding techniques, many parents find attempting to braid a child's hair prior to swimming to be a painful, frustrating experience. Further, many parents find it difficult to undo the braids after swimming without causing severe tangling of the hair and significant discomfort to the child.

Another attempt to prevent damage has been the use of leave-in conditioners. One drawback to leave-in conditioners is that the hair must be wetted prior to application of the conditioner. Other drawbacks to leave-in conditioners include releasing chemicals into the water during swimming and leaving the hair with a greasy feeling after swimming.

Moreover, neither the use of leave-in conditioners nor braiding the hair protects the hair from the potentially damaging effects of exposure to saltwater or chlorinated swimming pools. As such, there is an unaddressed need for hair covers that are water resistant, secure, lightweight, and capable of preventing tangles and water damage often encountered due to recreational swimming in pools, water parks, lakes, oceans, and the like.

SUMMARY

An apparatus and methods are provided for a water-resistant hair pouch that is secure, lightweight, easy to use, and capable of preventing tangles and water damage often encountered due to recreational swimming in pools, water parks, lakes, and oceans. The water-resistant hair pouch comprises a pouch that tapers from an opening to an apex. The opening provides access to a water-resistant cavity inside the pouch. An elastic loop coupled with the pouch, adjacent to the opening, is configured to be wrapped around a ponytail that is inserted through the opening into the water-resistant cavity. A drawstring facilitates cinching the opening around the base of the ponytail to minimize water exposure to the hair, or maintain a dry state of the hair, during immersion in water. Straps are attached to opposite sides of the pouch to enable a practitioner to secure the ponytail within a folded configuration of the pouch.

In an exemplary embodiment, a water-resistant hair pouch for protecting long hair from tangles and water damage during recreational swimming comprises: a pouch that tapers from an opening to an apex; an elastic loop coupled with the pouch adjacent to the opening; a drawstring configured to cinch the opening; and at least one strap attached to the pouch.

In another exemplary embodiment, the opening is configured to provide access to a water-resistant cavity inside the pouch. In another exemplary embodiment, the pouch is comprised of a pliable, lightweight, water-resistant material capable of minimizing water exposure to hair during immersion. In another exemplary embodiment, the elastic loop is configured to be wrapped around a group of hair, such as a ponytail that is inserted through the opening into a water-resistant cavity within the pouch.

In another exemplary embodiment, the drawstring is retained within an elongate passageway that extends around the perimeter of the opening. In another exemplary embodiment, the elongate passageway comprises a peripheral portion of the pouch adjacent to the opening that is folded over and attached to the body of the pouch. In another exemplary embodiment, the elongate passageway includes at least one opening that allows the drawstring to be looped outside of the elongate passageway. In another exemplary embodiment, the elongate passageway includes a first opening and a second opening that allow the drawstring to loop outside the elongate passageway on opposite sides of the opening roughly equidistant from the elastic loop. In another exemplary embodiment, the first and second openings are arranged around the opening to facilitate a practitioner grasping and pulling the drawstring to place the opening into a cinched state around the base of a ponytail that is wrapped in the elastic loop and inserted into the pouch.

In another exemplary embodiment, the at least one strap is constructed of a material similar to the material comprising the pouch. In another exemplary embodiment, the at least one strap is configured to enable a practitioner to secure a ponytail within a folded configuration of the pouch. In another exemplary embodiment, the at least one strap is configured to be wrapped around the pouch and secured to maintain folded configuration of the pouch. In another exemplary embodiment, the at least one strap comprises a first strap and a second strap that are configured to be tied into a bow or any form of knot suitable to secure the folded configuration of the pouch.

In an exemplary embodiment, a method for a water-resistant hair pouch to protect hair from tangles and water damage during recreational swimming comprises: forming a pouch that tapers from an opening to an apex; coupling an elastic loop with the pouch adjacent to the opening; configuring a drawstring to cinch the opening; constructing at least one strap; and attaching the at least one strap to the pouch.

In another exemplary embodiment, forming the pouch includes attaching together two flat portions of a flexible cloth, such that the flat portions are attached along lower angled edges, the apex, and upper angled edges adjacent to the opening. In another exemplary embodiment, forming the pouch includes coating the flexible cloth with a thin layer of neoprene, urethane, or other similar material. In another exemplary embodiment, configuring the drawstring includes folding over a peripheral portion of the opening and attaching the peripheral portion to a body of the pouch to form an elongate passageway that retains the drawstring. In another exemplary embodiment, constructing the at least one strap includes forming an elongate strip of flexible cloth suitable for being secured around the pouch. In another exemplary embodiment, attaching the at least one strap includes fastening the at least one strap to the pouch near the apex.

BRIEF DESCRIPTION OF THE DRAWINGS

The drawings refer to embodiments of the present disclosure in which.

Figure 1:
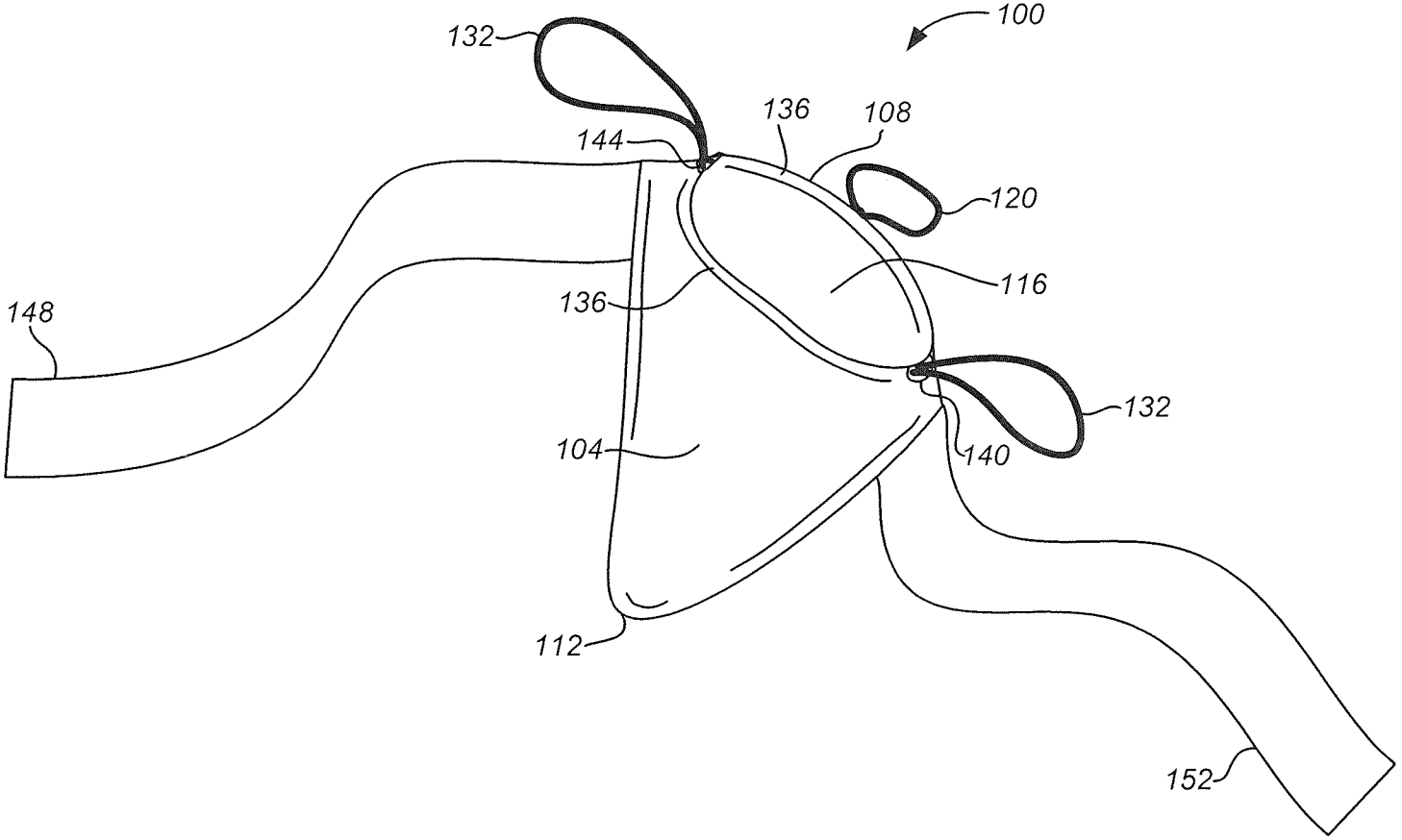
FIG. 1 illustrates a perspective view of an exemplary embodiment of a water-resistant hair pouch that is configured to protect long hair from tangles and water damage during recreational swimming in pools, water parks, lakes, and oceans.

While the present disclosure is subject to various modifications and alternative forms, specific embodiments thereof have been shown by way of example in the drawings and will herein be described in detail. The invention should be understood to not be limited to the particular forms disclosed, but on the contrary, the intention is to cover all modifications, equivalents, and alternatives falling within the spirit and scope of the present disclosure.

DETAILED DESCRIPTION

In the following description, numerous specific details are set forth in order to provide a thorough understanding of the present disclosure. It will be apparent, however, to one of ordinary skill in the art that the invention disclosed herein may be practiced without these specific details. In other instances, specific numeric references such as "first strap," may be made. However, the specific numeric reference should not be interpreted as a literal sequential order but rather interpreted that the "first strap" is different than a "second strap." Thus, the specific details set forth are merely exemplary. The specific details may be varied from and still be contemplated to be within the spirit and scope of the present disclosure. The term "coupled" is defined as meaning connected either directly to the component or indirectly to the component through another component. Further, as used herein, the terms "about," "approximately," or "substantially" for any numerical values or ranges indicate a suitable dimensional tolerance that allows the part or collection of components to function for its intended purpose as described herein.

Water exposure typically causes hair to become snarled and tangled that is painful to comb through, as well as damaged hair caused by both chemical (chlorine) or natural (salt water) elements. Conventional swimming caps tend to be heavy, uncomfortable, and aesthetically lacking for recreational water activities other than competitive swim meets. Removal of swimming caps typically causes undesirable pulling of the scalp, often leading to painfully tearing loose portions of the hair. Non-accessory techniques often include either braiding the hair or applying leave-in conditioners prior to swimming. However, neither the use of leave-in conditioners nor braiding the hair protects the hair from the potentially damaging effects of exposure to saltwater or chlorinated swimming pools. Embodiments disclosed herein provide a water-resistant hair pouch that is secure, lightweight, easy to use, and capable of preventing tangles and water damage often encountered due to recreational swimming in pools, water parks, lakes, oceans, and the like.

FIG. 1 illustrates a perspective view of an exemplary embodiment of a water-resistant hair pouch 100 that is configured to protect hair from tangles and water damage during recreational swimming in pools, water parks, lakes, oceans, and the like. It is contemplated that the water-resistant hair pouch 100 is not to be limited to protecting hair during recreational swimming, but rather the water-resistant hair pouch 100 may be used to protect hair during a wide variety of activities wherein water exposure may be encountered. For example, the water-resistant hair pouch 100 may be used as an alternative to a conventional shower cap so as to protect hair from becoming wet and tangled during showering, or the water-resistant hair pouch 100 may be used as an accessory to protect the hair during waterskiing, jet skiing, boating, as well as any other activity wherein hair has a tendency to become wet and tangled.

The water-resistant hair pouch 100 includes a pouch 104 that generally tapers from an opening 108 disposed atop the pouch to an apex 112 at a bottom of the pouch 104. The opening 108 provides access to a water-resistant cavity 116 inside the pouch 104 that is configured to receive hair, as described herein. The pouch 104 preferably is comprised of any pliable, lightweight, water-resistant material capable of minimizing water exposure to hair, or even maintaining the hair in a dry state, during immersion, such as, by way of non-limiting example, neoprene, urethane, treated ripstop, and the like. In some embodiments, for example, the pouch 104 may be comprised of a flexible cloth that is coated with a thin layer of neoprene, or other similar material. In one embodiment, the pouch 104 is comprised of a neoprene sheet having a thickness of substantially 0.5 millimeters (mm).

Figure 3:
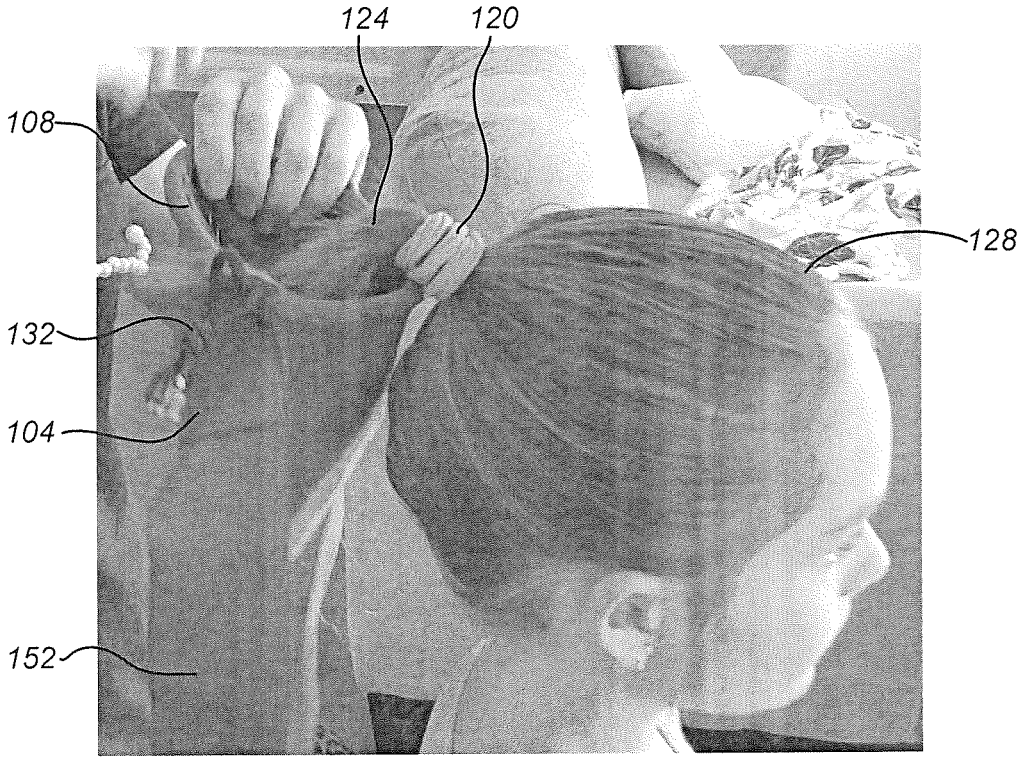
FIG. 3 illustrates an exemplary use environment wherein a ponytail is inserted into a water-resistant cavity of a water-resistant ponytail pouch.

In the embodiment of FIG. 1, an elastic loop 120 is coupled with the pouch 104 adjacent to the opening 108. The elastic loop 120 is configured to be wrapped around a group of long hair, such as a ponytail 124 as shown in FIG. 3. Specifically, FIG. 3 illustrates an exemplary use environment wherein the ponytail 124 of a practitioner 128 is inserted through the opening 108 into the water-resistant cavity 116. The elastic loop 120 shown in FIG. 3 is wound around the ponytail 124, thereby advantageously attaching the water-resistant hair cover 100 to the hair of the practitioner 128.

It is contemplated that, in some embodiments, the elastic loop 120 may be wrapped around a ponytail 124 that is already formed by way of a rubber band, or other similar device, or the elastic loop 120 may be wrapped around the hair to form the ponytail 124 in lieu of the rubber band, as desired. In general, however, it is intended that the elastic loop 120 is understood to be exemplary in nature, and thus it should be recognized that the elastic loop 120 may comprise any of various fasteners capable of advantageously attaching the water-resistant hair cover 100 to the hair of the practitioner 128, without limitation. Further, in some embodiments, the elastic loop 120 may be omitted from the water-resistant hair cover 100 in instances wherein the hair is grouped into the ponytail 124 by way of a rubber band, or other similar device, as desired.

With reference again to FIG. 1, the water-resistant hair pouch 100 includes a drawstring 132 that is retained within an elongate passageway 136 that extends around the perimeter of the opening 108. It is contemplated that the elongate passageway 136 may be forming by folding a peripheral portion of the pouch 104 adjacent to the opening 108 over and stitching the peripheral portion onto the body of the pouch 104. The elongate passageway 136 generally includes at least one opening 140 that allows the drawstring 132 to be looped outside of the elongate passageway 136 for the purpose of being grasped by way of a hand.

Figure 4:
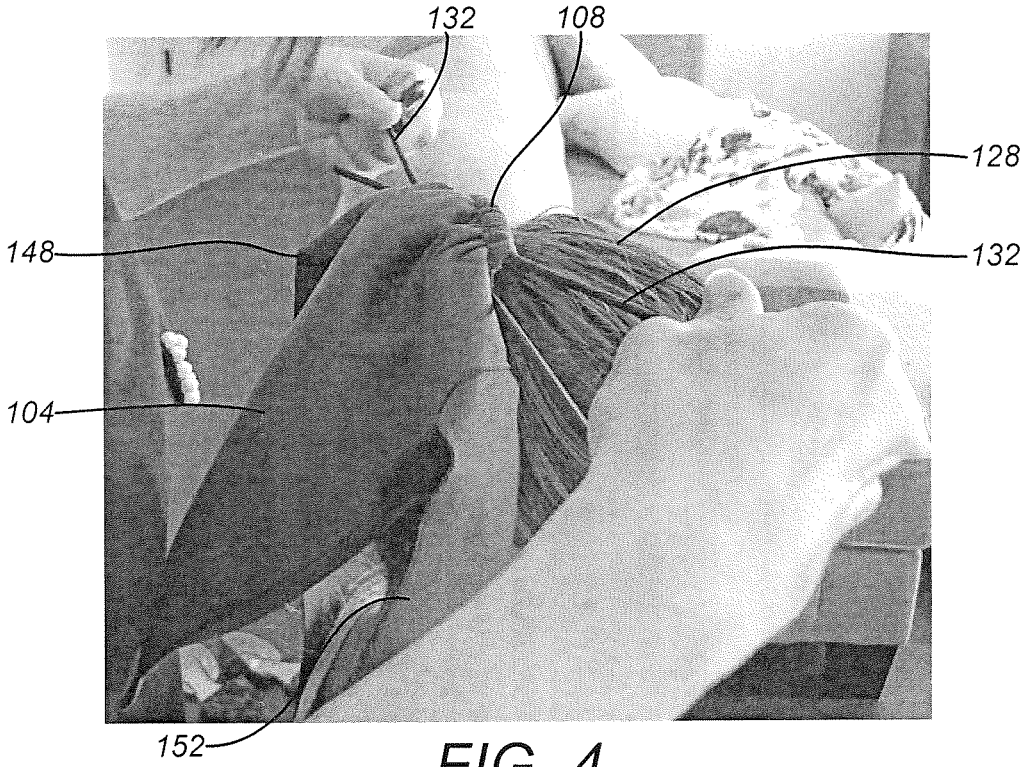
FIG. 4 illustrates an exemplary use environment wherein the water-resistant ponytail pouch of FIG. 3 is cinched around the base of the ponytail by way of drawstrings comprising the water-resistant ponytail pouch.

In the embodiment of FIG. 1, the elongate passageway 136 includes a first opening 140 and a second opening 144 that allow the drawstring 132 to loop outside the elongate passageway 136 on opposite sides of the opening 108 roughly equidistant from the elastic loop 120. The positions of the first and second openings 140, 144 facilitate grasping and pulling the loops of the drawstring 132 to place the opening 108 into a cinched state. As best shown in FIG. 4, once the ponytail 124 is positioned in the water-resistant cavity 116 and fixated by way of the elastic loop 120, the loops of the drawstring 132 may be pulled to tightly cinch the opening 108 around the base of the ponytail 124. As will be appreciated, cinching the opening 108 around the base of the ponytail 124 advantageously secures the water-resistant hair pouch 100 to the practitioner's hair without painfully tugging on portions of the hair as is commonplace with conventional swimming caps.

As shown in the embodiment of FIG. 1, the water-resistant hair pouch 100 includes a first strap 148 and a second strap 152 that are attached to opposite sides of the pouch 104. In general, the first and second straps 148, 152 are constructed of a material similar to the material comprising the pouch 104, such as, by way of non-limiting example, neoprene, urethane, treated ripstop or flexible cloth, and the like. For example, in some embodiments the first and second straps 148, 152 are comprised of a flexible cloth material that is coated with a thin layer of neoprene, or other similar material. In some embodiments, the first and second straps 148, 152 are comprised of a neoprene sheet having a thickness of substantially 0.5 mm. In some embodiments, however, the neoprene may be omitted from flexible cloth straps 148, 152 without deviating beyond the spirit and scope of the present invention.

It should be understood that the water-resistant hair pouch 100 is not limited to including the first and second straps 148, 152. For example, in some embodiments, the water-resistant hair pouch 100 includes only one strap that may be wrapped around the pouch 104, as described herein. In some embodiments, the water-resistant hair pouch 100 includes one or two straps that include Velcro to assist with securing the pouch 104 in a folded configuration, as discussed in connection with FIGS. 5-8. In some embodiments, the water-resistant hair pouch 100 includes a single strap that includes a Velcro hook portion on one side of the strap and a Velcro loop portion on the other side of the strap. Thus, the single strap may be wrapped around the pouch 104 with the Velcro loop portion attached to the Velcro hook portion to maintain the folded configuration of the pouch 104. It is further contemplated that, in some embodiments, the first and second straps 148, 152 may be omitted from the water-resistant hair pouch 100 in lieu of fastening portions disposed on the exterior of the pouch 104, including, by way of non-limiting example, Velcro portions, buttons and loops, snaps, and the like, without limitation, and without deviating beyond the spirit and scope of the present invention.

Figure 1A:
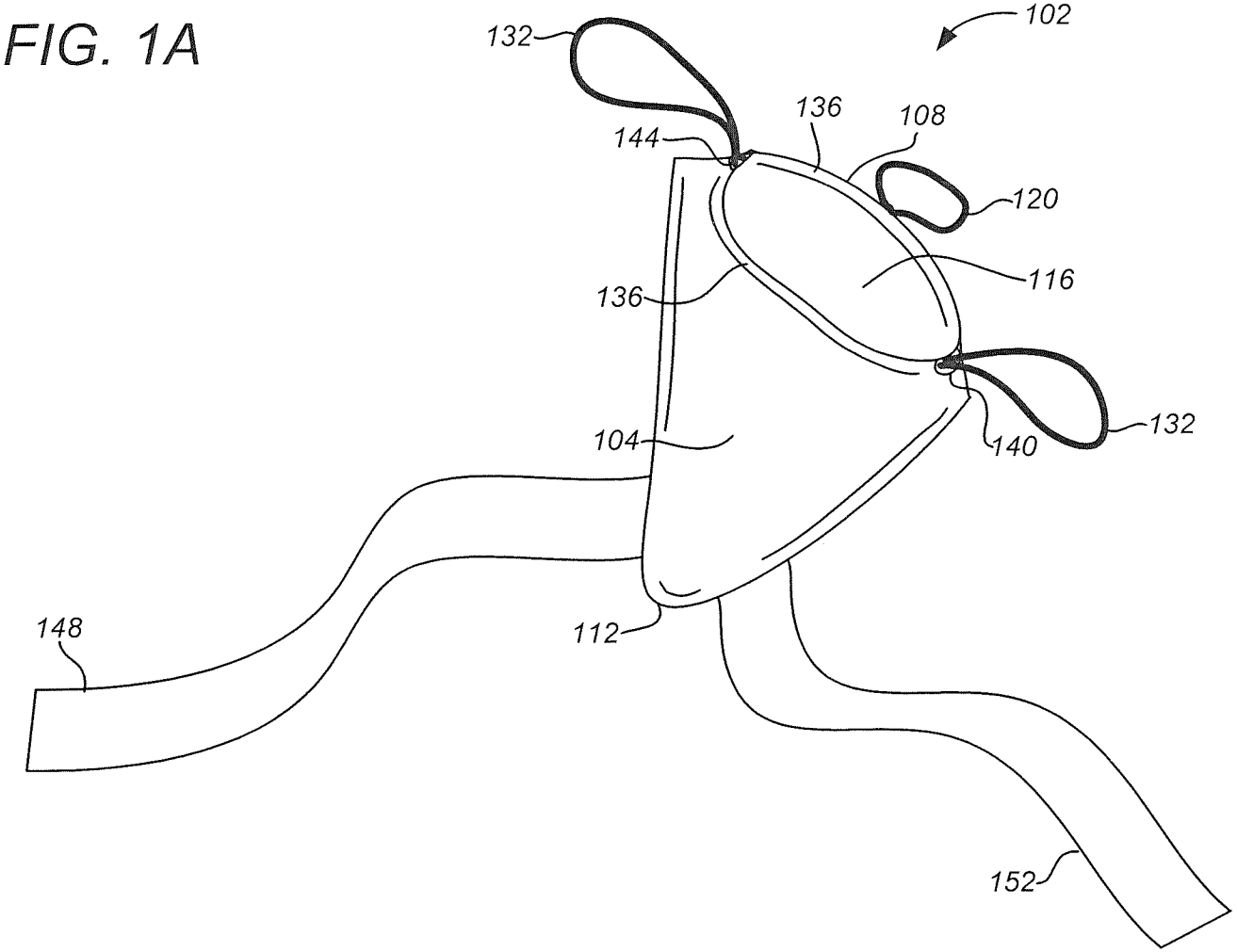
FIG. 1A illustrates a perspective view of an exemplary embodiment of a water-resistant hair pouch that is configured to protect long hair from tangles and water damage during recreational swimming in pools, water parks, lakes, and oceans.

Moreover, it is contemplated that the straps 148, 152 need not be attached to the pouch 104 near the opening 108, as shown in FIG. 1. For example, in an exemplary embodiment shown in FIG. 1A, a water-resistant hair pouch 102 that is substantially identical to the water-resistant hair pouch 100, shown in FIG. 1, includes a first strap 148 and a second strap 152 that are attached to the pouch 104 adjacent to the apex 112. It is contemplated that attaching the first and second straps 148, 152 near the apex 112 simplifies rolling the pouch 104 into a folded configuration, as discussed in connection with FIGS. 5-8.

The first and second straps 148, 152 enable the practitioner 128 to secure the ponytail 124 in a folded, or rolled up, configuration of the water-resistant ponytail pouch 100, as shown in FIGS. 5-8. It is contemplated that the folded configuration of the water-resistant ponytail pouch 100 discussed herein below advantageously holds the ponytail 124 in a water-proof state during swimming in pools, water parks, lakes, oceans, and the like without subjecting the practitioner 128 to painful tugging on portions of the hair and scalp during removal of the pouch 100. It is further contemplated that confining movement of the ponytail 124 during swimming enables the practitioner 128 to comb through the hair after swimming without having to struggle with tangles and water damage often caused by water exposure.

Figure 5:
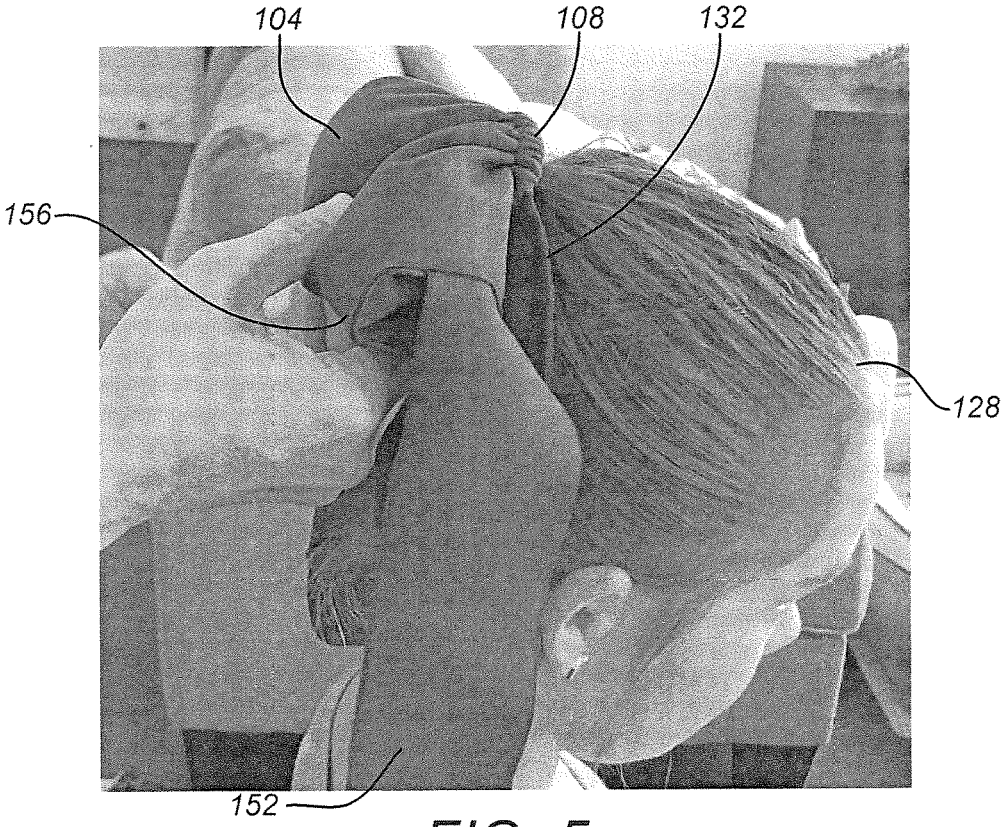
FIG. 5 illustrates an exemplary use environment wherein a water-resistant ponytail pouch is cinched onto the base of a ponytail and is being placed into a folded (or rolled) configuration.
Figure 6:
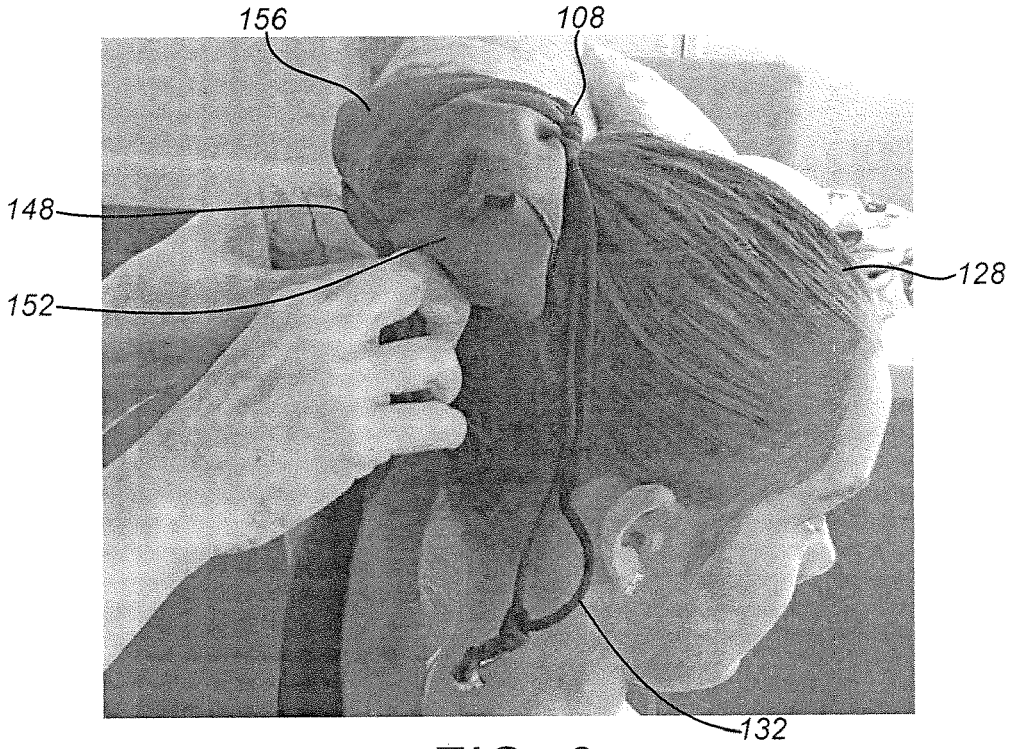
FIG. 6 illustrates an exemplary use environment wherein the folded configuration of FIG. 5 is being maintained by folding (wrapping) straps underneath the water-resistant ponytail pouch.
Figure 7:
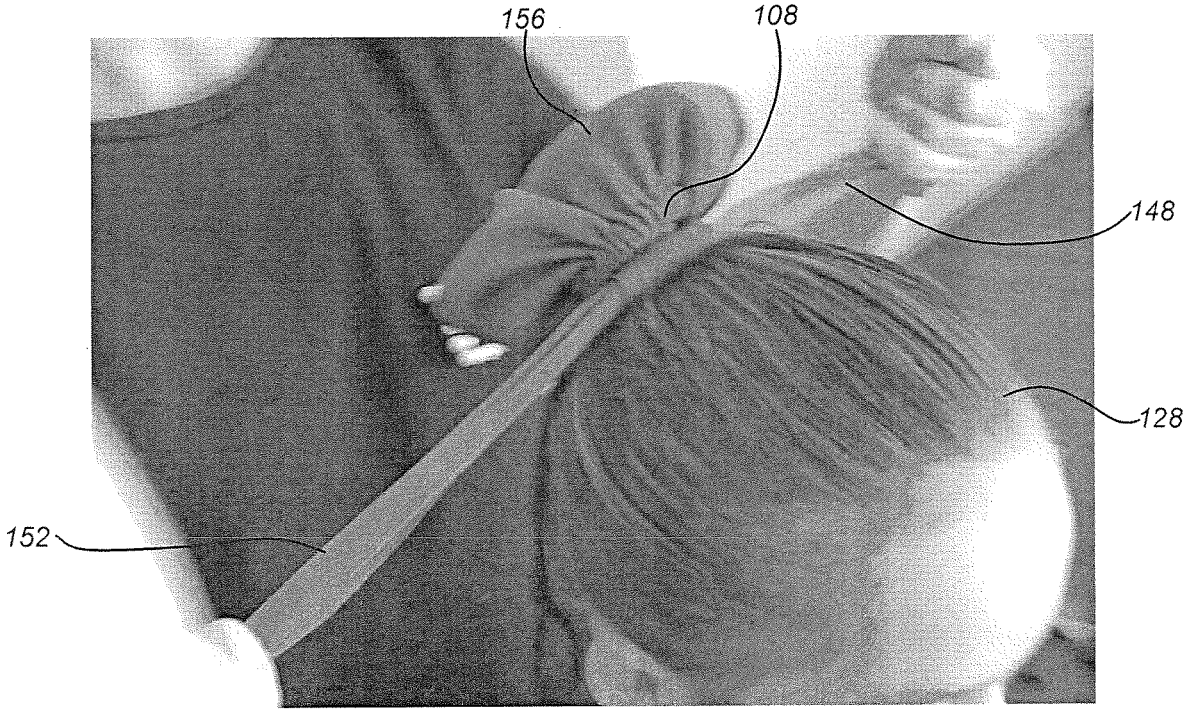
FIG. 7 illustrates an exemplary use environment wherein the folded configuration of FIG. 5 is being secured by tying straps together on top of the water-resistant ponytail pouch.

Referring, now, to FIG. 5, the water-resistant ponytail pouch 100 is shown with the opening 108 cinched onto the base of the ponytail 124, as described hereinabove. After cinching the opening 108 by way of the drawstring 132, the pouch 104 may be placed into a folded configuration 156 by tucking the apex 112 under the body of the pouch 104 and rolling or folding the pouch upwards until reaching the edge of the cinched opening 108. As shown in FIG. 6, the folded configuration 156 of the pouch 104 may be maintained by initially folding the first and second straps 148, 152 underneath the pouch 104. Next, while maintaining the folded configuration 156 of the pouch 104, the practitioner 128 may loop the first and second straps 148, 152 in opposite directions around the pouch 104 such that the straps 148, 152 are on top of the folded configuration 156 of the pouch 104. As shown in FIG. 7, the practitioner 128 may secure the folded configuration 156 of the pouch 104 by tying the first and second straps 148, 152 together on top of the pouch 104. It should be understood that the straps 148, 152 are not limited to being looped in opposite directions before being secured, but rather the straps 148, 152 are intended to be looped and secured in any of various arrangements suitable for maintaining the pouch in the folded configuration without limitation, and without deviating from the scope of the present invention.

Figure 8:
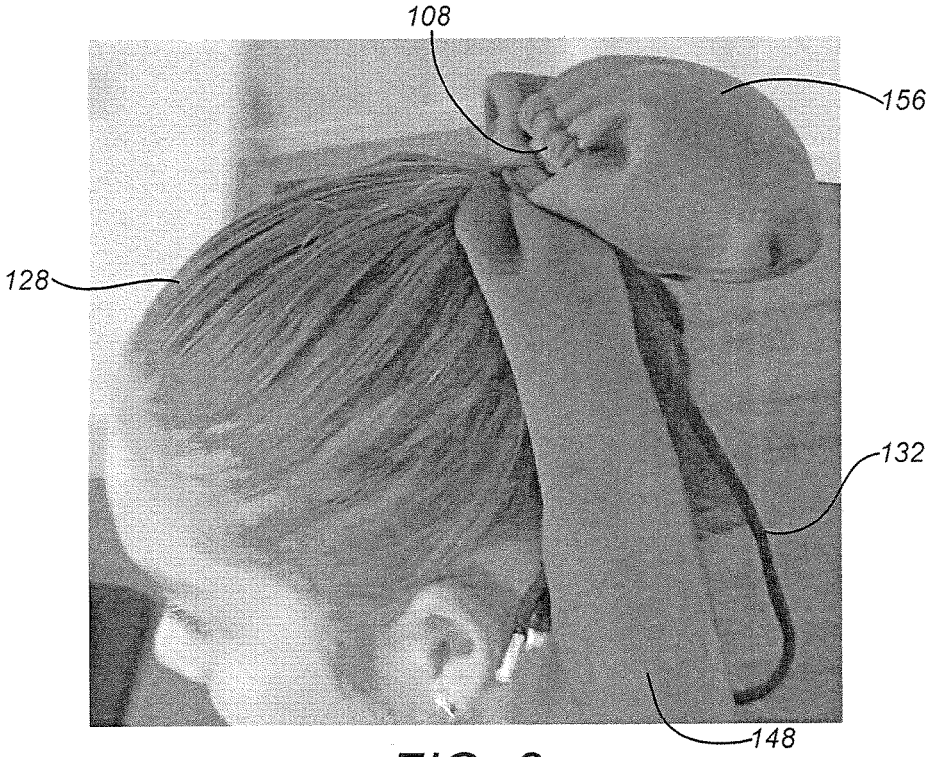
FIG. 8 illustrates an exemplary use environment wherein the water-resistant ponytail pouch of FIG. 5 is fully installed onto the hair of a practitioner in a manner suitable for swimming.

FIG. 8 illustrates the water-resistant ponytail pouch 100 installed onto the hair of the practitioner 128 in a manner suitable for swimming. It is contemplated that after tying the first and second straps 148, 152, as described with respect to FIG. 7, the practitioner 128 may opt to further secure the water-resistant ponytail pouch 100 to the ponytail 124 by tying the straps 148, 152 into a bow or forming the straps 148, 152 into any of various suitable knots, as desired. As will be appreciated, tying the straps 148, 152 into a bow or a knot provides further protection against slippage of the pouch 100 on the hair, compresses the hair into a tighter volume, and advantageously prevents water from leaking into the water-resistant cavity 116.

Figure 2A:
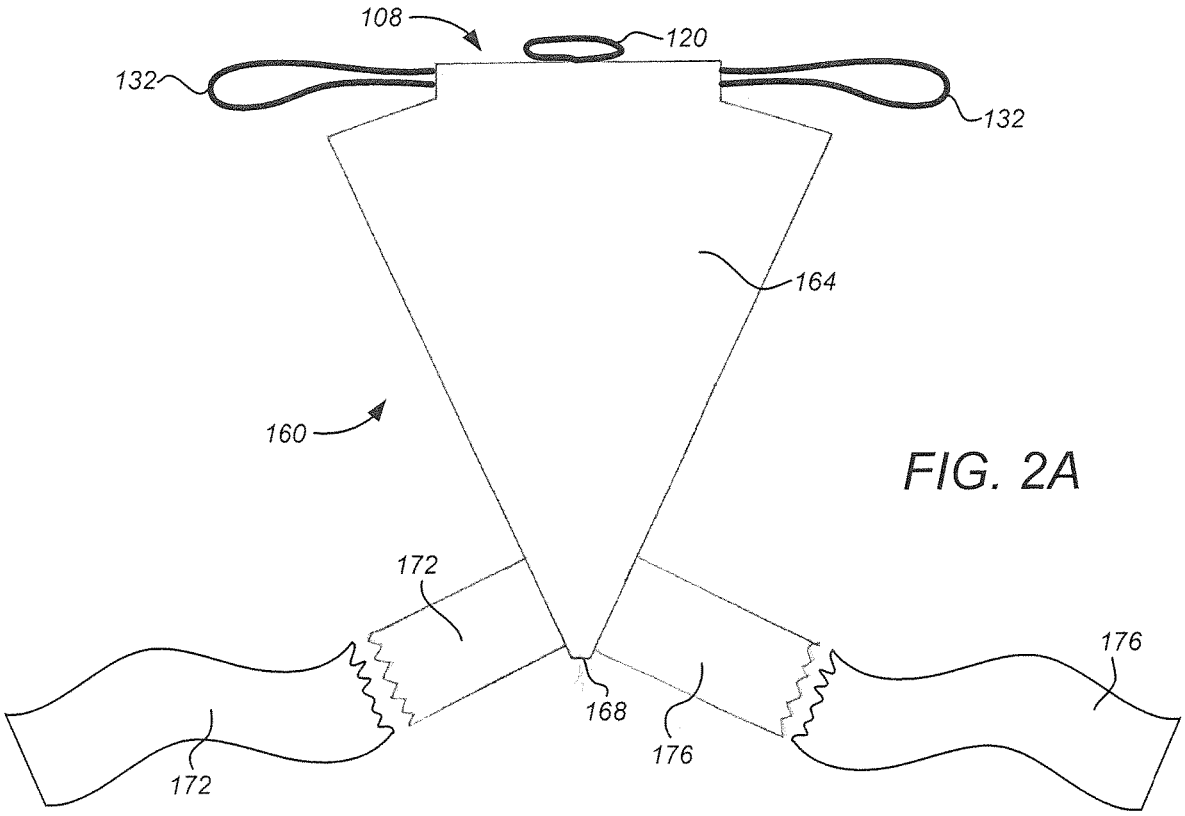
FIG. 2A illustrates a plan view of an exemplary embodiment of a water-resistant hair pouch that is configured to protect long hair from tangles and water damage during recreational swimming in pools, water parks, lakes, and oceans.

FIG. 2A illustrates a plan view of an exemplary embodiment of a water-resistant hair pouch 160 that is configured to protect long hair from tangles and water damage during recreational swimming in pools, water parks, lakes, oceans, and the like. The water-resistant hair pouch 160 is substantially similar to the water-resistant hair pouch 100, shown in FIG. 1, with the exception that the water-resistant hair pouch 160 includes a pouch 164 having a beveled apex 168, and includes a first strap 172 and a second strap 176 that are attached to the pouch 164 adjacent to the beveled apex 168. It is contemplated that attaching the first and second straps 172, 176 near the beveled apex 168 simplifies rolling the pouch 164 into the folded configuration 156 and more effectively secures the pouch 160 to the ponytail 124, as discussed in connection with FIGS. 5-8.

Figure 2B:
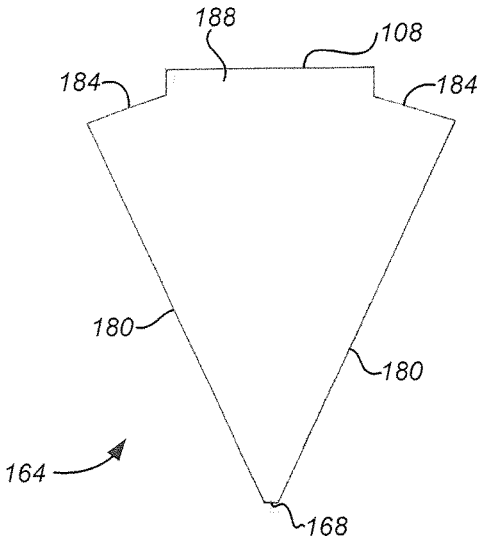
FIG. 2B illustrates a plan view of an exemplary embodiment of a pouch that may be incorporated into the water-resistant ponytail pouch of FIG. 2A.

FIG. 2B illustrates a plan view of an exemplary embodiment of the pouch 164 that may be incorporated into the water-resistant ponytail pouch 160 of FIG. 2A. In general, the pouch 164 comprises two flat portions of a flexible cloth, or other suitable material, that are stitched or otherwise attached together along lower angled edges 180, the beveled apex 168, and upper angled edges 184. In the embodiment illustrated in FIG. 2B, the pouch 164 comprises a length of 12 inches from the opening 108 to the beveled apex 168. The lower angled edges 180 each has a length of 11½ inches, and the beveled apex 168 has a length of ½ inches. It should be understood, however, that the beveled apex 168 may be omitted in lieu of a pointed apex, such as the apex 112, as desired.

With continuing reference to FIG. 2B, while the pouch 164 is laying in the flat configuration, the opening 108 has a length of about 5¾ inches. A peripheral portion 188 of the opening 108 may extend roughly 1½ inches beyond the union between the lower and upper angled edges 180, 184 and have a width of ¾ inches beyond the upper angled edges 184. As discussed hereinabove with respect to FIG. 1, it is contemplated that the peripheral portion 188 may be folded over and stitched, or otherwise attached, to the body of the pouch 164 to form the elongate passageway 136 that retains the drawstring 132. It is further contemplated that the pouch 164 preferably is comprised of a pliable, water-resistant material capable of maintaining hair in a dry state during immersion in water. In some embodiments, the pouch 164 is comprised of a flexible cloth that is coated with a thin layer of neoprene, or other similar material.

Figure 2C:
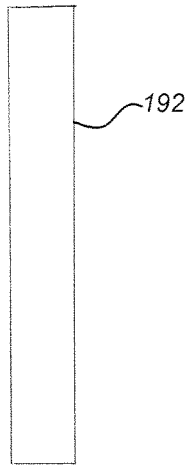
FIG. 2C illustrates a plan view of an exemplary embodiment of a strap that may be fastened onto the pouch of FIG. 2B.

FIG. 2C illustrates a plan view of an exemplary embodiment of a strap 192 that may be fastened onto the pouch 164 of FIG. 2B to form either of the first and second straps 172, 176. In the illustrated embodiment, the strap 192 has a length of 14 inches and a width of 2 inches. In general, the strap 192 is constructed of a material similar to the material comprising the pouch 164. In some embodiments, for example, the strap 192 is comprised of a flexible cloth material that is coated with a thin layer of neoprene, or other similar material. In some embodiments, however, the neoprene may be omitted from the strap 192 without deviating beyond the spirit and scope of the present invention.

While the invention has been described in terms of particular variations and illustrative figures, those of ordinary skill in the art will recognize that the invention is not limited to the variations or figures described. In addition, where methods and steps described above indicate certain events occurring in certain order, those of ordinary skill in the art will recognize that the ordering of certain steps may be modified and that such modifications are in accordance with the variations of the invention. Additionally, certain steps may be performed concurrently in a parallel process when possible, as well as performed sequentially as described above. To the extent there are variations of the invention, which are within the spirit of the disclosure or equivalent to the inventions found in the claims, it is the intent that this patent will cover those variations as well. Therefore, the present disclosure is to be understood as not limited by the specific embodiments described herein, but only by scope of the appended claims.

What is claimed is:

1. An apparatus for protecting long hair from tangles and water damage during recreational swimming, the apparatus comprising:

a pouch providing a water resistant cavity that tapers from an opening to an apex comprising a closed bottom of the pouch;

an elastic loop coupled with the pouch adjacent to the opening;

a drawstring configured to cinch the opening; and at least one strap attached to the pouch.

2. The apparatus of claim 1, wherein the opening is configured to provide access to the water-resistant cavity inside the pouch.

3. The apparatus of claim 1, wherein the pouch is comprised of a pliable, lightweight, water-resistant material capable of minimizing water exposure to hair during immersion.

4. The apparatus of claim 1, wherein the elastic loop is configured to be wrapped around a group of hair, including a ponytail that is inserted through the opening into the water-resistant cavity within the pouch.

5. The apparatus of claim 1, wherein the drawstring is retained within an elongate passageway that extends around a perimeter of the opening.

6. The apparatus of claim 5, wherein the elongate passageway includes at least one opening that allows the drawstring to be looped outside of the elongate passageway.

7. The apparatus of claim 6, wherein said at least one opening is a first opening and a second opening that allow the drawstring to loop outside the elongate passageway on opposite sides of the pouch opening equidistant from the elastic loop.

8. The apparatus of claim 7, wherein the first and second openings are arranged around the opening to facilitate a practitioner grasping and pulling the drawstring to place the opening into a cinched state around the base of a ponytail that is wrapped in the elastic loop and inserted into the pouch.

9. The apparatus of claim 1, wherein the at least one strap is constructed of the same material as the pouch.

10. The apparatus of claim 1, wherein the at least one strap is configured to enable a practitioner to secure a ponytail within a folded configuration of the pouch.

11. The apparatus of claim 10, wherein the at least one strap is configured to be wrapped around the pouch and secured to maintain the folded configuration of the pouch.

12. The apparatus of claim 11, wherein the at least one strap comprises a first strap and a second strap that are configured to be tied into a bow or any form of knot suitable to secure the folded configuration of the pouch.

13. A method for a water-resistant hair pouch to protect hair from tangles and water damage during recreational swimming, the method comprising:

forming a pouch that tapers from an opening to an apex;

coupling an elastic loop with the pouch adjacent to the opening;

configuring a drawstring to cinch the opening;

constructing at least one strap; and attaching the at least one strap to the pouch.

14. The method of claim 13, wherein forming the pouch includes attaching together two flat portions of a flexible cloth, such that the flat portions are attached along lower angled edges, the apex, and upper angled edges adjacent to the opening.

15. The method of claim 14, wherein forming the pouch includes coating the flexible cloth with a thin layer of neoprene, urethane, or other similar material.

16. The method of claim 13, wherein configuring the drawstring includes folding over a peripheral portion of the opening and attaching the peripheral portion to a body of the pouch to form an elongate passageway that retains the drawstring.

17. The method of claim 13, wherein constructing the at least one strap includes forming an elongate strip of flexible cloth suitable for being secured around the pouch.

18. The method of claim 13, wherein attaching the at least one strap includes fastening the at least one strap to the pouch near the apex.

19. The method of claim 13, wherein a fastener comprises an elastic loop that is configured to be wrapped around a group of hair, including a ponytail that is inserted through the opening into the water-resistant cavity within the pouch.

20. An apparatus for protecting long hair from tangles and water damage during recreational swimming, the apparatus comprising:

a pouch providing a water resistant cavity that tapers from an opening to an apex comprising a closed bottom of the pouch;

an elastic loop configured to attach wrap around a group of hair including a ponytail that is inserted through the opening into the water-resistant cavity within the pouch;

a drawstring configured to cinch the opening; and at least one fastening portion disposed on an exterior of the pouch.

* * * * *